US006475019B1

(12) United States Patent
Zielke et al.

(10) Patent No.: US 6,475,019 B1
(45) Date of Patent: Nov. 5, 2002

(54) INSULATION DISPLACEMENT ELECTRICAL CONNECTOR

(75) Inventors: Darrell W. Zielke, Bothell, WA (US); Philip R. Mansur, Bothell, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 09/905,746

(22) Filed: Jul. 12, 2001

(51) Int. Cl.[7] ..... H01R 4/24; H01R 4/26; H01R 11/20; H01R 9/05

(52) U.S. Cl. ..... 439/404; 439/595

(58) Field of Search ..... 439/404, 536, 439/701, 725, 402, 403, 595, 603, 405

(56) References Cited

U.S. PATENT DOCUMENTS

| | | | | |
|---|---|---|---|---|
| 3,496,522 A | | 2/1970 | Ellis, Jr. et al. | |
| 3,611,264 A | | 10/1971 | Ellis, Jr. | |
| 4,059,331 A | * | 11/1977 | Sedlacek et al. | 439/404 |
| 4,106,837 A | | 8/1978 | Paluch | |
| 4,869,685 A | * | 9/1989 | Olsson | 439/404 |
| 4,964,812 A | | 10/1990 | Siemon et al. | 439/403 |
| 5,409,404 A | | 4/1995 | Reed | 439/736 |
| 5,591,045 A | | 1/1997 | Pepe et al. | 439/460 |
| 5,645,445 A | | 7/1997 | Siemon et al. | 439/395 |
| 5,711,067 A | | 1/1998 | Jenner et al. | 29/874 |
| 6,007,368 A | | 12/1999 | Lorenz et al. | 439/418 |
| 6,050,842 A | | 4/2000 | Ferrill et al. | 439/404 |
| 6,056,584 A | | 5/2000 | Daoud | 439/403 |
| 6,086,407 A | | 7/2000 | Daoud | 439/405 |
| 6,213,809 B1 | | 4/2001 | Viklund | 439/418 |

* cited by examiner

*Primary Examiner*—Khiem Nguyen
*Assistant Examiner*—Chandrika Prasad
(74) *Attorney, Agent, or Firm*—George C. Rondeau, Jr.; Davis Wright Tremaine LLP

(57) ABSTRACT

An electrical connector having a body with a plurality of contact cavities therein, and a plurality of insulation penetrating beam contacts received within the cavities. Each contact has a first end portion to engage a wire located at a first cavity end and a second end portion with a protrusion at a second cavity end. The connector also includes a plurality of resilient spring arms positioned adjacent to the contact cavities. Each arm has a hinge portion attached to the body and a resiliently movable free end portion with a receiving aperture receiving therein the contact protrusion when the contact is in the contact cavity at which the spring arm is positioned. The second cavity end is open and the spring arm is resiliently movable to permit insertion and removal of the contact through the open end.

38 Claims, 6 Drawing Sheets

INSULATION DISPLACEMENT ELECTRICAL CONNECTOR

TECHNICAL FIELD

This invention relates to an electrical connector, and in particular, to a wire termination block utilizing a plurality of slotted beam contacts for a 110-style connector.

BACKGROUND OF THE INVENTION

The 110-style connector is frequently used in the telephone industry to electrically interconnect a set of first conductors such as insulated wires to a set of second conductors such as conductive paths on a printed circuit board. Alternatively, the second set of conductors can be a second set of insulated wires. The connector includes a dielectric body and a plurality of slotted beam insulation displacement contacts retained within the body. In use, one or more insulated wires are positioned with one insulated wire above each slotted beam contact. A force is applied to press each insulated wire into a slot of the corresponding slotted beam contact. The slotted beam contact cuts through the insulation and grasps the metal wire therein thereby making good electrical contact with the wire. The body is usually made of a plastic material.

When manufacturing the 110-style connector, each slotted beam contact is inserted into a cavity in the plastic body and must be retained therein to prevent dislodgement during use and handling, preferably allowing minimum movement of the contact within the body cavity. Holding the slotted beam contacts securely within the body cavity can be a particular problem because of the large force required to press the insulated wires into the slots of the slotted beam contacts. If the slotted beam contacts can move too much within the body cavity once inserted and secured therein, their movement can make difficult alignment of the wires with the slots of the contacts.

In the past, the slotted beam contacts have been held within their body cavities by various means. For example, in U.S. Pat. Nos. 4,964,812 and 5,645,445, the slotted beam contact and the body each have an opening. Once the slotted beam contact is within the body cavity, a pin is inserted in the aligned contact and body openings to hold the contact in place. This must be done for each slotted beam contact and involves an extra part and manufacturing step, thus increasing the cost of manufacturing the connector. Further, the pin allows the slotted beam contact to move within the body cavity more than desirable.

In U.S. Pat. No. 5,409,404, the body cavity for each slotted beam contact has a thin walled section that is engaged with a tool after the contact is in the body cavity to sever three sides of the wall section and bend it into engagement with the contact to hold the contact within the body cavity. Again, this involves an extra step and increases cost.

In U.S. Pat. No. 5,711,067, each slotted beam contact has a tab portion that is bent using a punch tool after the contact is inserted into the body cavity to engage the tab portion with the body to retain the contact within the body cavity. This also involves an extra step and increases cost, and the contact still may move within the body cavity more than desired.

In U.S. Pat. No. 3,611,264, each slotted beam contact has a pair of mounting arms that extend into slots in the body when the contact is inserted into the body cavity. Somewhat similarly, in U.S. Pat. Nos. 3,496,522 and 6,050,842, the slotted beam contacts each have a pair of spring tabs that extend into corresponding apertures in the body when the contact is inserted into the body cavity.

In U.S. Pat. No. 6,056,584, each slotted beam contact has a pair of opposed recesses and within the body cavity for the contact there are a pair of protrusions that snap fit into the recesses to hold the contact in place.

In U.S. Pat. No. 4,106,837, each slotted beam contact has a plurality of bosses that deform the plastic walls of the body when the contact is press-fit into the body cavity and thereby grasp the walls to hold the contact in place.

While a variety of manners exist to retain a slotted beam contact within its body cavity, none retain the contact as securely as desired to prevent dislodgement while still allowing quick, easy and inexpensive manufacturing of the connector, using rapid automatic assembly with minimal parts and assembly steps, and allowing minimum movement of the contact within the body cavity.

SUMMARY OF THE INVENTION

The present invention is embodied in an electrical connector of the type for electrically interconnecting a first set of insulated wire conductors with a second set of conductors. The connector includes a body having a plurality of contact cavities therein, each contact cavity having an open first end for receiving one of the insulated wire conductors of the first set of conductors and an opposite second end. The connector further includes a plurality of insulation penetrating beam contacts, each contact sized to be received within one of the contact cavities. Each contact has a first end portion located at the first cavity end and an opposite second end portion located at the second cavity end of the contact cavity in which the contact is positioned. The first end portion is configured to displace the insulation and make electrical contact with the wire of one of the insulated wire conductors of the first set of conductors.

The connector also includes a plurality of resilient spring arms. Each spring arm is positioned adjacent to one of the contact cavities, and has a first portion attached to the body and a resiliently movable second portion. One of the second end portion of the contact and the second portion of the spring arm has a protrusion and the other has a receiving aperture receiving therein the protrusion when the contact is in the contact cavity at which the spring arm is positioned with the receiving aperture in registration with the protrusion. In the illustrated embodiment, the first portion of the spring arm is a resilient hinge portion attached to the body and the second portion is a free end portion. Further, in the illustrated embodiment, the spring arm includes a mid-portion between the hinge portion and the free end portion. The receiving aperture is in the mid-portion of the spring arm, and the protrusion is on the second end portion of the contact and projects outwardly therefrom. In addition, the free end portion of each arm has a ramped portion positioned to engage the protrusion on the contact in the contact cavity at which the arm is positioned as the contact is inserted into the contact cavity from the open contact insertion end thereof.

In the illustrated embodiment, the second cavity end of the contact cavity is open. Further, the spring arm second portion is positioned to contact and be resiliently moved in response to the spring arm second portion engaging the contact by an amount sufficient to permit insertion of the contact into the contact cavity through the open second cavity end to position the receiving aperture in registration with the protrusion. The spring arm second portion is sufficiently resiliently movable to further allow the spring arm second portion to be resiliently moved by an amount sufficient to disconnect the protrusion from the receiving aperture to permit the removal of the contact from the contact cavity through the open second cavity end.

In the illustrated embodiment, the second cavity end is open, and the second end portion of each contact includes a terminal portion extending out of the open second cavity end and beyond the body. Further, the illustrated embodiment has the body and the spring arms formed with a one-piece construction.

The illustrated embodiment is constructed for use with a test probe. The receiving apertures are through-holes in the spring arms having an outward opening sized to receive the test probe sufficiently far therein to make electrical contact with the contact in the contact cavity at which the spring arm with the through-hole is positioned.

Other features and advantages of the invention will become apparent from the following detailed description, taken in conjunction with the accompanying drawings.

DETAILED DESCRIPTION OF THE INVENTION

Figure 1:
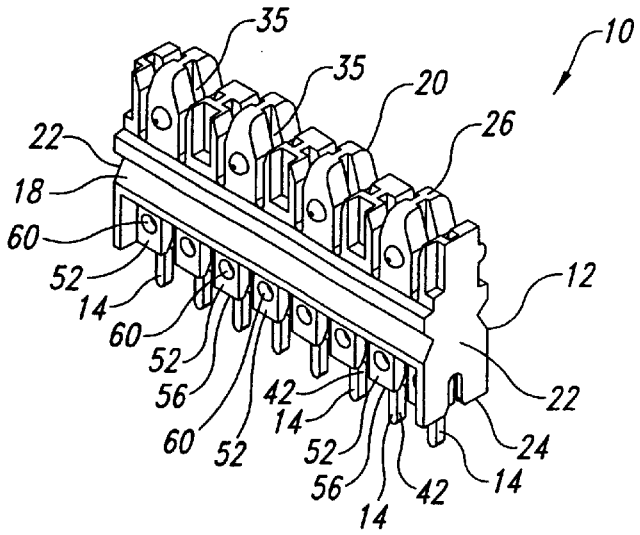
FIG. 1 is an isometric view of an electrical connector embodying the present invention.

An embodiment of an electrical connector 10 of the present invention is illustrated in FIG. 1 fully assembled and ready for use. The connector 10 includes a dielectric housing or body 12 and a plurality of planar slotted beam contacts 14. In the illustrated embodiment, eight slotted beam contacts 14 are used, but a fewer or greater number may be used as desired for the connector. The body 12 is typically formed of plastic, and the slotted beam contacts 14 are formed of a platted conductive metal.

Figure 2:
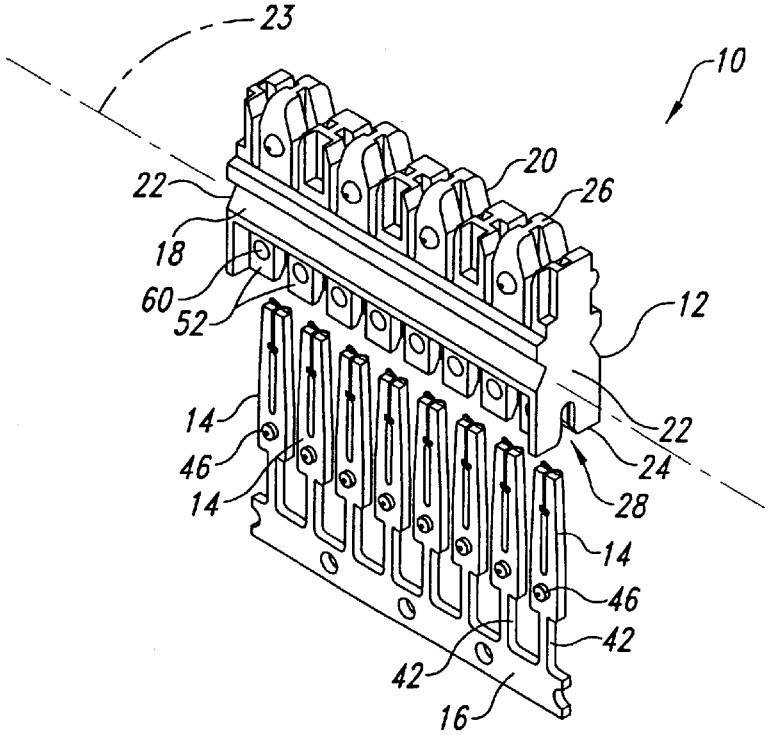
FIG. 2 is an isometric view of the body and slotted beam contacts of the electrical connector shown in FIG. 1 with the slotted beam contacts positioned for installation into the body.
Figure 3:
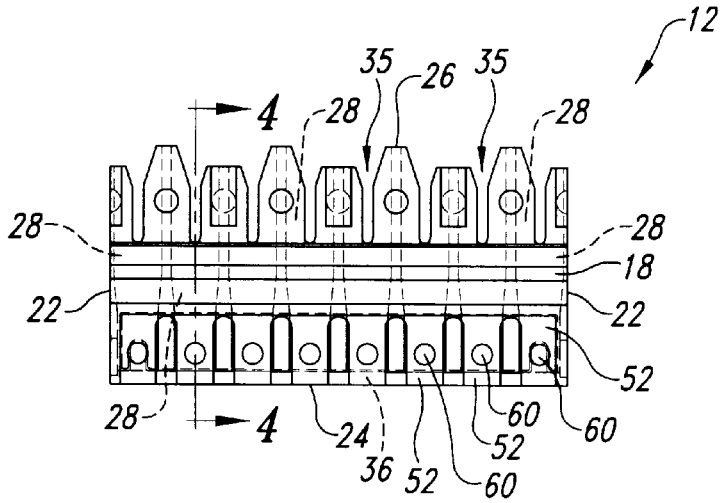
FIG. 3 is a front elevational view of the electrical connector body shown in FIG. 2 without the slotted beam contacts.
Figure 4:
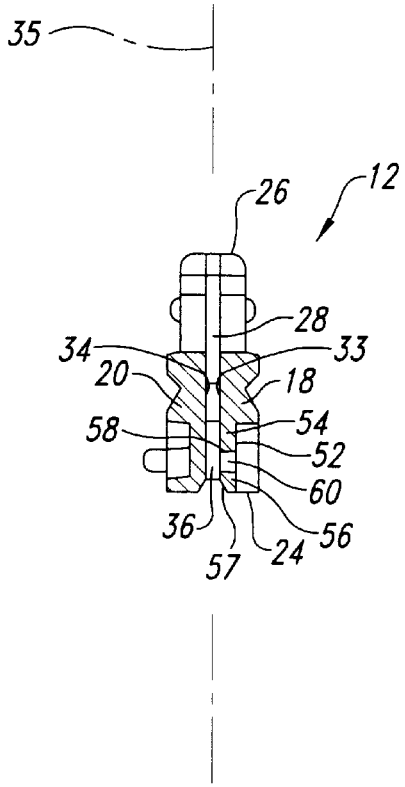
FIG. 4 is a cross-sectional view of the electrical connector body of FIG. 3 taken substantially along line 4—4 of FIG. 3.
Figure 5:
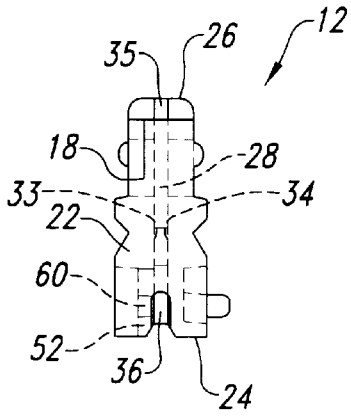
FIG. 5 is a right side elevational view of the electrical connector body of FIG. 3.
Figure 6:
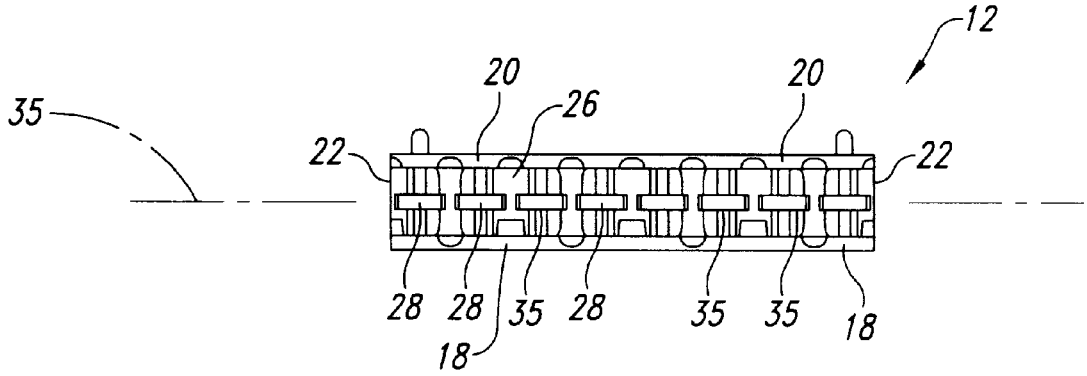
FIG. 6 is a top plan view of the electrical connector body of FIG. 3.
Figure 7:
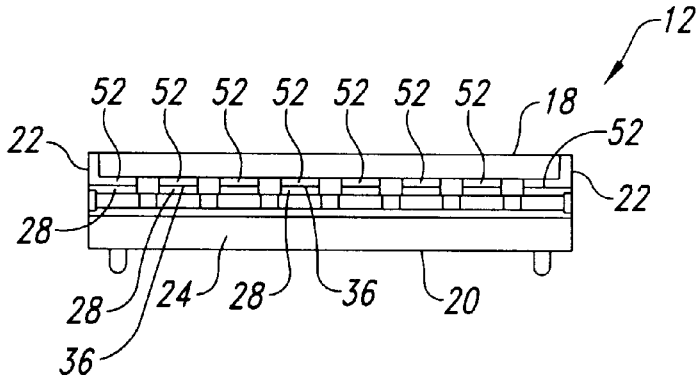
FIG. 7 is a bottom plan view of the electrical connector body of FIG. 3.
Figure 8:
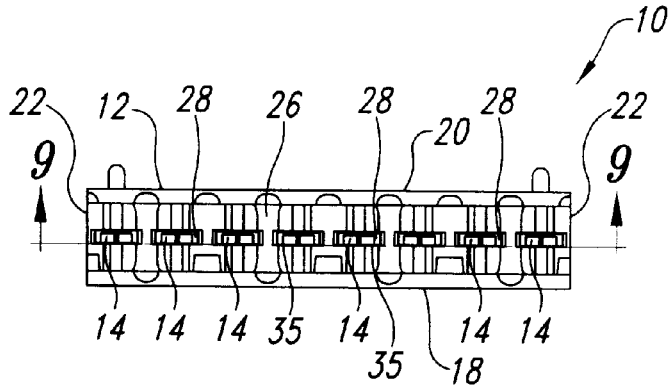
FIG. 8 is a top plan view of the electrical connector of FIG. 1 with the slotted beam contacts installed in the electrical connector body.

The body 12 and the slotted beam contacts 14 are shown in FIG. 2 with the contacts separated from the body, in position for insertion into body. The slotted beam contacts 14 are manufactured as a long leadframe with many contacts connected together by a bar 16 which is cut off after the contacts are inserted into the body 12. As perhaps best shown by FIGS. 3–7 where the body 12 is shown prior to insertion of the slotted beam contacts 14, the body has a front wall 18, a back wall 20 and a pair of left and right end walls 22. The body 12 further includes a contact loading face 24 and a wire insertion face 26. Within the body 12, as best illustrated in FIGS. 3 and 4, there are eight elongated body slots or cavities 28, each sized and shaped to receive one of the slotted beam contacts 14. The body 12 is shown in FIGS. 8–12 with the slotted beam contacts 14 positioned within the body cavities 28 and the bar 16 removed.

The body cavities 28 each have left and right interior side wall portions 30 shaped and spaced apart to conform to left and right edge wall portions 32 of the slotted beam contact 14 inserted therein and snuggly retain the contact within the body cavity against left to right movements and rotational movements. The interior side wall portions 30 of the body cavities 28 and the edge wall portions 32 of the slotted beam contacts 14 have a substantially perpendicular orientation so that the edge wall portions mate well with the interior side wall portions to provide a good interference fit. Each body cavity 28 also includes a flat front wall portion 33 and a flat rear wall portion 34, spaced apart to receive and snuggly retain the contact 14 therebetween.

Figure 9:
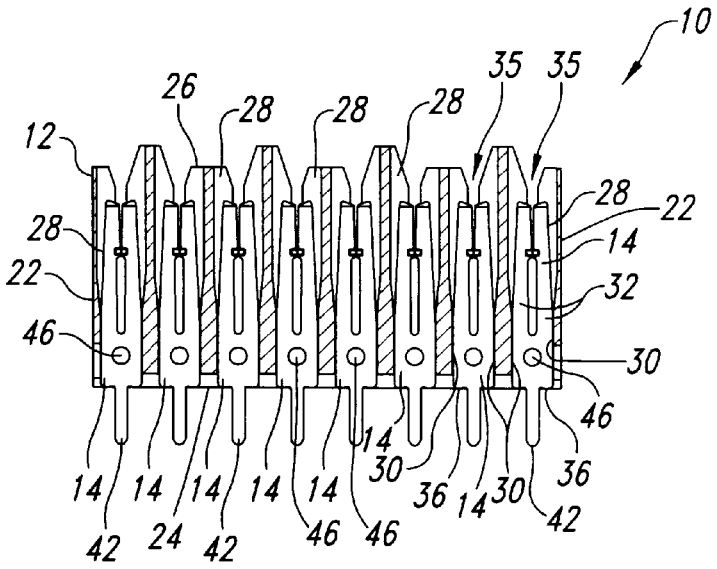
FIG. 9 is a cross-sectional view of the electrical connector of FIG. 1 taken substantially along line 9—9 of FIG. 8 showing each of the slotted beam contacts received within a body cavity.
Figure 10:
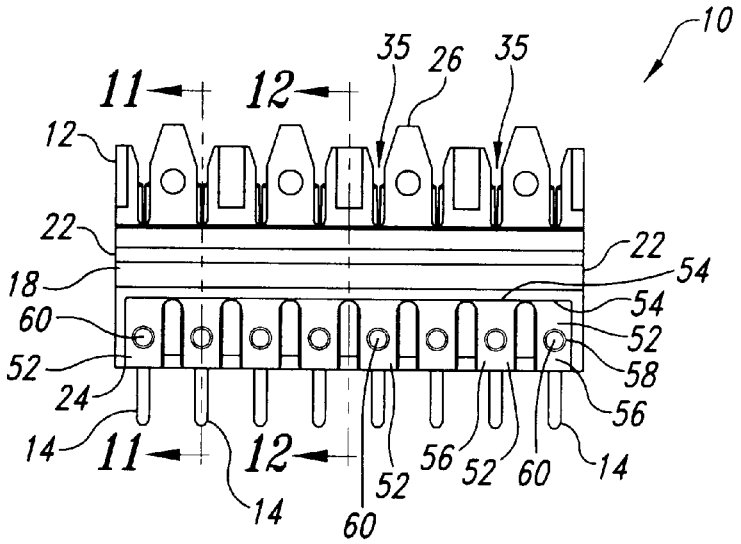
FIG. 10 is a front elevational view of the electrical connector of FIG. 1.
Figure 11:
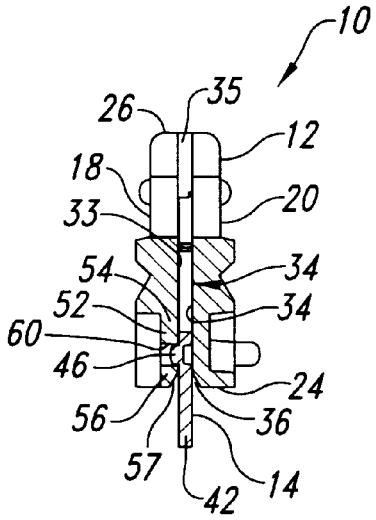
FIG. 11 is a cross-sectional view of the electrical connector of FIG. 1 taken substantially along line 11—11 of FIG. 10.
Figure 12:
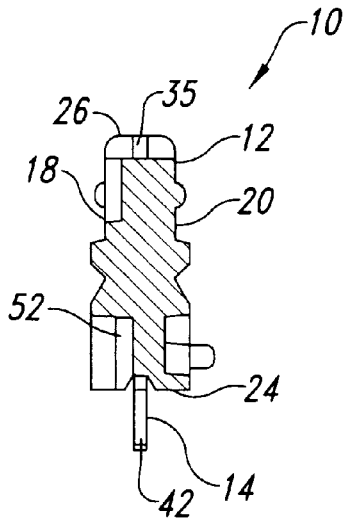
FIG. 12 is a cross-sectional view of the electrical connector of FIG. 1 taken substantially along line 12—12 of FIG. 10.

In addition, the body cavities 28 each have an open end 35 toward the wire insertion face 26 of the body 12 for pressing a wire into engagement with the slotted beam contact 14 within the body cavity, and an opposite open insertion end 36 toward the contact loading face 24 of the body for insertion of the contact into the body cavity, as best shown in FIG. 9.

Figure 13:
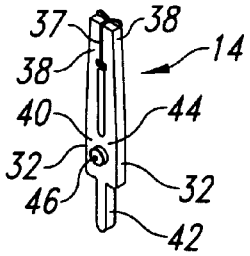
FIG. 13 is an isometric view on one of the slotted beam contacts of FIG. 2.
Figure 14:
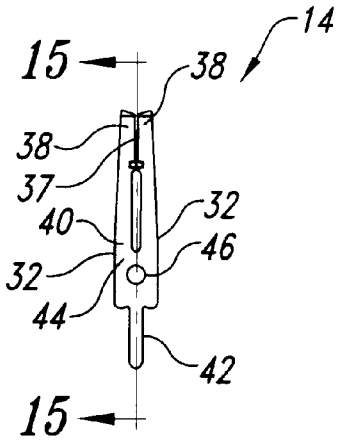
FIG. 14 is front elevational view of the slotted beam contacts of FIG. 13.
Figure 15:
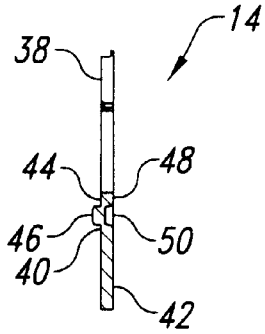
FIG. 15 is a cross-sectional view of the slotted beam contact of FIG. 14 taken substantially along line 15—15 of FIG. 14.

One of the slotted beam contacts 14 is illustrated in FIGS. 13–15 separated from the bar 16. Each slotted beam contact 14 includes an insulation cutting and wire conductor receiving slot 37 formed by a pair of flat arms 38 extending away from a mid-portion 40 of the contact. Extending away from the mid-portion 40 in an opposite direction is a solder terminal 42 that is insertable into a solder hole in a printed circuit board (not shown) for soldering therein to make electrical contact with a conductive trace on the circuit board. In other style connectors, another pair of arms with an insulation cutting and wire conductor receiving slot could be used in lieu of the solder terminal 42. Projecting from a flat front face 44 of the mid-portion 40 of the slotted beam contact 14 is a protruding detent or boss 46. As best seen in FIG. 15, in the illustrated embodiment, the slotted beam contact 14 is stamped from a flat rear face 48 at location 50 to deform the metal of the contact to protrude forwardly and form the boss 46 on the front face 44. As a result, a depression is left at location 50 on the rear face 48 of the mid-portion 40.

The slotted beam contacts 14 are die cut from a flat strip of metal to provide a generally flat profile other than the boss 46 stamped therein. The flat front and rear faces 44 and 48 of the slotted beam contact 14 when within the body cavity 28 are in face-to-face contact with and held tightly between the flat front and rear wall portions 33 and 34, respectively, of the body cavity to snuggly retain the contact 14 against forward and reward movement.

The front wall 18 of the body 12 includes eight elongated spring arms or fingers 52, one for each of the slotted beam contacts 14 used in the connector 10. Each spring finger 52 is located in longitudinal alignment with one of the body cavities 28. The spring finger 52 has a proximal end portion 54 integrally formed as part of the front wall 18 of the body 12 and a distal free end portion 56 located toward the open insertion end 36 of the body cavity toward the contact loading face 24 of the body. The proximal end portion 54 serves as a resilient hinge to permit resilient flexing of the distal end portion 56 of the spring finger away from and toward the body cavity 28 and the slotted beam contact 14 as the contact is inserted into and positioned within the body cavity.

The distal end portion 56 of the spring finger 52 is positioned spaced away from the rear wall portion 34 of the body cavity 28 by about the thickness of the flat arms 38 of the slotted beam contact 14 so that the flat arms can be freely and easily inserted into the body cavity 28 through the open insertion end 36 of the cavity without flexing of the spring finger 52. As the slotted beam contact 14 is further inserted into the body cavity 28 with the front face 44 having the boss 46 facing toward the spring finger 52, a ramped portion 57 of the distal end portion 56 of the spring finger 52 slidably engages the boss 46 and causes the spring finger to bend or flex in a direction away from the contact. As will be appreciated, the flat profile of the slotted beam contact 14, other than the boss 46 formed in the mid-portion 40 of the contact, facilitates its insertion into the body cavity 28.

A mid-portion 58 of the spring finger 52, located between the proximal end portion 54 and the distal end portion 56, has a retaining hole 60 sized and positioned to snuggly receive therein the boss 46 of one of the slotted beam contacts 14 when the contact is sufficiently inserted into the body cavity 28 at which the spring finger 52 is located. The retaining hole 60 is circular with a diameter slightly larger than the diameter of the boss 46, which is also circular in cross-section. When inserted sufficiently that the boss 46 is in registration with and received in the retaining hole 60 of the spring finger 52, the spring finger flexes in a direction toward the contact and captures the boss 46 in the retaining hole 60, thereby holding the contact securely within the body cavity 28 against movement therein and removal from the body cavity. The slotted beam contact 14 and the spring finger 52 are sized and arranged such that when the contact is being held by the spring finger, the contact is held tightly in a position within the body cavity 28 with the flat arms 38 of the contact, and the slot 37 therebetween, toward the wire insertion face 26 of the body 12 in position to receive an insulated wire, and with the solder terminal 42 extending beyond the contact loading face 24 of the body in position for insertion in solder holes of a printed circuit board.

The retaining hole 60 extends fully through the mid-portion 58 of the spring finger 52; however, alternatively, an aperture such as a recess in an inward face of the spring finger 52 with a depth and width sufficient to receive and hold the boss 46 can be used. Alternatively, the spring finger 52 could include a boss and the slotted beam contact 14 an aperture to receive the boss of the spring finger. While the proximal end portion 54 has been described above to serve as a resilient hinge to permit resilient flexing of the distal end portion 56 of the spring finger 52, the distal end portion 56 and even the mid-portion 58 of the spring finger are resilient and flex somewhat along their lengths to provide a portion of the resilient and flexible characteristic of the spring finger described above to permit the receipt and releasable capture the boss 46 in the retaining hole 60.

As noted above, the distal end portion 56 of the spring finger 52 has the ramped portion 57. The ramped portion 57 is angled to slope away from the rear wall portion 34 of the body cavity 28 in the direction toward a free end of the distal end portion 56. The ramped portion 57 is located on the distal end portion 56 to engage the boss 46 of the slotted beam contact 14 as the contact is inserted into the body cavity 28 and progressively lift the spring finger 52 away from the contact to facilitate the easy insertion of the contact into the body cavity and the registration of the boss with the retaining hole 60 of the spring finger.

By forming the spring fingers 52 integrally with the body 12, a simplified one-piece body construction is achieved and assembly of the connector 10 is significantly simplified, thus reducing the cost of manufacture. The slotted beam contacts 14 are easily inserted into the cavities 28 of the body 12 until the bosses 46 of the contacts are snap fit into the corresponding retaining holes 60 of the spring fingers 52, also reducing the cost of manufacture. The design of the connector 10 allows rapid automatic assembly by reducing the number of parts and processes required. Further, no use of ultrasonic welding, chemical bonding, staking of separate anchoring members or cold form bonding is required.

As noted above, the slotted beam contacts 14 are manufactured as a long leadframe with the bar 16 connecting many contacts together. As such, in actuality, assembly is accomplished by bringing the body 12 to the leadframe and aligning the eight cavities 28 of the body with eight of the slotted beam contacts 14, and then pushing the body toward the leadframe to simultaneously insert the eight contacts into the eight body cavities and cause the eight spring fingers 52 to simultaneously snap over the eight bosses 46 of the contacts. The leadframe with bodies so attached is then processed to cut the bar 16 off and leave the slotted beam contacts in the bodies and the bodies with contacts thereby separated from each other.

Figure 16:
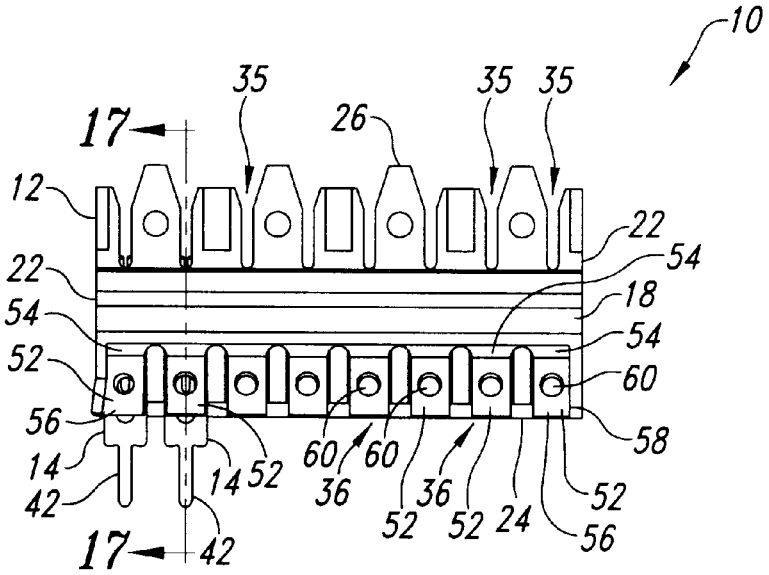
FIG. 16 is a front elevational view of the electrical connector of FIG. 1 with two slotted beam contacts shown partially inserted into cavities of the body.
Figure 17:
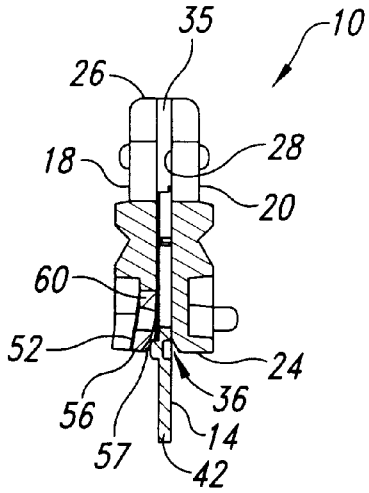
FIG. 17 is a cross-sectional view of the partially assembled electrical connector of FIG. 16 taken substantially along line 17—17 of FIG. 16.

One of the bodies 12 is shown in FIGS. 16 and 17 with two of the slotted beam contacts 14 partially inserted in their respective body cavities 28 for purposes of illustration, although upon original manufacture the contacts are attached to the bar 16 and all eight contacts are inserted simultaneously. In FIG. 17, one of the spring fingers 52 can be seen flexing outward away from the slotted beam contact 14 as it is inserted into its body cavity 28. Once the slotted beam contact 14 is sufficiently inserted to bring its boss 46 into registration with the retaining hole 60 in the spring finger 52, the spring finger flexes inward and clamps the contact securely within the body cavity with the boss retained in the retaining hole 60.

With the spring fingers 52 of the body 12 providing a snap locking means, the design and assembly of the connector 10 is simplified, yet the slotted beam contacts 14 are held securely in their respective body cavities 28. The plastic of the body 12, and hence the spring fingers 52, has sufficient resiliency and memory to allow the spring fingers to be flexed for insertion of the slotted beam contacts 14 and still return to their original positions with a snap action and securely hold the contacts in place. The plastic is selected to provide a positive snap-in action without the plastic significantly deforming or distorting, or shearing so that the spring fingers 52 keep the slotted beam contacts securely held in their respective body cavities 28 after insertion and during use of the connector 10.

Should it be necessary to replace the body 12 of the connector 10 in the event of its damage in the field, such as after the slotted beam contacts 14 have been soldered to a printed circuit board, the spring fingers 52 can be pried outward using a small screw driver, awl or other appropriate tool to allow the bosses 46 to clear the retaining holes 60 and thus release the contacts from the damaged body. The damaged body 12 can then be replaced with a new one. Alternatively, should it be necessary to replace one or more of the slotted beam contacts 14 after having been soldered to a printed circuit board, the spring fingers 52 can be flexed as described above to remove the body 12 from the contacts, and then only the bad contacts removed from the printed circuit board and replaced. A new body 12 can then be aligned with the solder contacts 14 to receive them back into the body cavities 28 of the new body.

As previously described, the retaining hole 60 of each spring finger 52 extends fully through the mid-portion 58 of the spring finger. In addition to serving to capture the boss 46 therein, the retaining hole 60 provides access to the slotted beam contact 14 in the body cavity 28 at which the spring finger 52 is located for purposes of making electrical contact therewith. The retaining hole 60 is sufficiently large in diameter that a test or troubleshooting probe can be inserted therein far enough to make electrical contact with the boss 46 of the slotted beam contact 14 in the body cavity 28. In such manner, even after the connector 10 is fully assembled with the slotted beam contacts 14 retained securely within the body cavities 28, a troubleshooting probe can be used to separately contact each of the metal slotted beam contacts to verify continuity or check the electrical signal on a slotted beam contact without disassembly of the connector. The boss 46 of the slotted beam contact 14 has a height such that when retained in the retaining hole 60, the interior sidewall of the retaining hole projects outward beyond the outward end of the boss, thus providing a walled recess above the boss into which the tip of the troubleshooting probe can be inserted and retained against unintended lateral movement thereof. The sidewall of the retaining hole 60 thus holds the tip of the probe on location and prevents accidental electrical contact with adjacent slotted beam contacts 14.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. An electrical connector of the type for electrically interconnecting a first set of insulated wire conductors with a second set of conductors, the connector comprising:

a dielectric body having a plurality of contact cavities therein, each contact cavity having an open wire receiving end and an opposite open contact insertion end;

a plurality of planar slotted beam contacts, each contact sized to be inserted through the open contact insertion end of one of the contact cavities and removably positioned within the contact cavity, each contact having a first end portion located at the open wire receiving end of the contact cavity and an opposite second end portion located at the open contact insertion end of the contact cavity in which the contact is positioned, the first end portion configured to displace the insulation and make electrical contact with the wire of one of the insulated wire conductors of the first set of conductors and the second end portion having an outward facing side with a protrusion projecting away from the outward side; and a plurality of resilient arms, each arm positioned adjacent to the open contact insertion end of one of the contact cavities, each arm having a hinge portion attached to the body, a free end portion and a mid-portion therebetween, the mid-portion of the arm having a receiving aperture sized and positioned to receive and capture therein the protrusion of the contact in the contact cavity at which the arm is positioned when the contact is within the contact cavity, the hinge portion of the arm having sufficient resiliency to allow the mid-portion of the arm to be resiliently moved away from the outward side of the second end portion of the contact in the contact cavity at which the arm is positioned as the contact is inserted into the contact cavity from the open contact insertion end thereof in response to engagement of the free end portion with the protrusion of the contact and resiliently moved toward the outward side of the second end portion of the contact when the receiving aperture is in registration with the protrusion of the contact to position the protrusion in the receiving aperture of the arm.

2. The connector of claim 1 wherein the resiliency of the hinge portion of the arm is sufficient to allow the mid-portion of the arm to be resiliently moved away from the outward side of the second end portion of the contact to release the protrusion from the receiving aperture for removal of the contact from the contact cavity through the open contact insertion end thereof after the contact is first inserted into the contact cavity.

3. The connector of claim 1 wherein the second end portion of each contact has a terminal portion extending out of the open contact insertion end of the contact cavity and beyond the body.

4. The connector of claim 1 wherein the free end portion of each arm has a ramped portion positioned to engage the protrusion of the contact in the contact cavity at which the arm is positioned as the contact is inserted into the contact cavity from the open contact insertion end thereof.

5. The connector of claim 1 wherein the body and the arms are formed with a one-piece construction.

6. The connector of claim 1, for use with a test probe, wherein the receiving apertures are through-holes in the arms, each through-hole having an outward opening sized to receive the test probe sufficiently far therein to make electrical contact with the contact in the contact cavity at which the arm with the through-hole is positioned.

7. An electrical connector of the type for electrically interconnecting a first set of insulated wire conductors with a second set of conductors, the connector comprising:

a body having a plurality of contact cavities therein, each contact cavity having an open wire receiving end and an opposite open contact insertion end;

a plurality of insulation penetrating contacts, each contact sized to be inserted through the open contact insertion end of one of the contact cavities and removably positioned within the contact cavity, each contact having a first end portion located at the open wire receiving end of the contact cavity and an opposite second end portion located at the open contact insertion end of the contact cavity in which the contact is positioned, the first end portion being configured to displace the insulation and make electrical contact with the wire of one of the insulated wire conductors of the first set of conductors and the second end portion having a protrusion projecting outward; and a plurality of arms, each arm positioned adjacent to the open contact insertion end of one of the contact cavities, each arm having an attachment portion attached to the body, a free end portion and a mid-portion therebetween, the mid-portion of the arm having a receiving aperture sized and positioned to receive and capture therein the protrusion of the contact in the contact cavity at which the arm is positioned, the mid-portion of the arm being resiliently movable away from the second end portion of the contact in the contact cavity at which the arm is positioned as the contact is inserted into the contact cavity from the open contact insertion end thereof in response to engagement of the free end portion with the protrusion of the contact and being resiliently movable toward the second end portion of the contact when the receiving aperture is in registration with the protrusion of the contact to position the protrusion in the receiving aperture of the arm.

8. The connector of claim 7 wherein the mid-portion of the arm is sufficiently resiliently movable to allow the mid-portion to be again moved away from the second end portion of the contact to release the protrusion from the receiving aperture for removal of the contact from the contact cavity through the open contact insertion end thereof.

9. The connector of claim 7 wherein the attachment portion of the arm provides a hinged attachment of the arm to the body and has sufficient resiliency to allow the mid-portion of the arm to be resiliently moved away from the second end portion of the contact to release the protrusion from the receiving aperture for removal of the contact from the contact cavity through the open contact insertion end thereof.

10. The connector of claim 7 wherein the second end portion of each contact has a terminal portion extending out of the open contact insertion end of the contact cavity and beyond the body.

11. The connector of claim 7 wherein the free end portion of each arm has a ramped portion positioned to engage the protrusion of the contact in the contact cavity at which the arm is positioned as the contact is inserted into the contact cavity from the open contact insertion end thereof.

12. The connector of claim 7 wherein the body and the arms are formed with a one-piece construction.

13. The connector of claim 7, for use with a test probe, wherein the receiving apertures are through-holes in the arms, each through-hole having an outward opening sized to receive the test probe sufficiently far therein to make electrical contact with the contact in the contact cavity at which the arm with the through-hole is positioned.

14. An electrical connector of the type for electrically interconnecting a first set of insulated wire conductors with a second set of conductors, the connector comprising:

a dielectric body having a plurality of contact cavities therein, each contact cavity having an open first end for receiving one of the insulated wire conductors of the first set of conductors and an opposite second end;

a plurality of insulation penetrating beam contacts, each contact sized to be snuggly received within one of the contact cavities, each contact having a first end portion located at the first cavity end and an opposite second end portion located at the second cavity end of the contact cavity in which the contact is positioned, the first end portion configured to displace the insulation and make electrical contact with the wire of one of the insulated wire conductors of the first set of conductors; and a plurality of spring arms to releasably retain the contacts in the contact cavities, each spring arm being positioned adjacent to the second cavity end of one of the contact cavities, each spring arm having a resilient hinge portion attached to the body and a free end portion, one of the second end portion of the contact and the free end portion of the spring arm having a protrusion and the other having a receiving aperture sized and positioned to receive and capture therein the protrusion when the contact is in the contact cavity at which the spring arm is positioned with the receiving aperture in registration with the protrusion.

15. The connector of claim 14 wherein the second cavity end is open, and the second end portion of each contact has a terminal portion extending out of the open second cavity end and beyond the body.

16. The connector of claim 14 wherein the body and the spring arms are formed with a one-piece construction.

17. The connector of claim 14 for use with a probe, wherein the receiving apertures are through-holes in the spring arms, each through-hole having an outward opening sized to receive the probe therein to make electrical contact with the contact in the contact cavity at which the spring arm is positioned.

18. An electrical connector of the type for electrically interconnecting a first set of insulated wire conductors with a second set of conductors, the connector comprising:

a body having a plurality of contact cavities therein, each contact cavity having an open first end for receiving one of the insulated wire conductors of the first set of conductors and an opposite second end;

a plurality of insulation penetrating beam contacts, each contact sized to be received within one of the contact cavities, each contact having a first end portion located at the first cavity end and an opposite second end portion located at the second cavity end of the contact cavity in which the contact is positioned, the first end portion configured to displace the insulation and make electrical contact with the wire of one of the insulated wire conductors of the first set of conductors; and a plurality of resilient spring arms, each spring arm positioned adjacent to one of the contact cavities, each spring arm having a first portion attached to the body and a resiliently movable second portion, one of the second end portion of the contact and the second portion of the spring arm having a protrusion and the other having a receiving aperture receiving therein the protrusion when the contact is in the contact cavity at which the spring arm is positioned with the receiving aperture in registration with the protrusion.

19. The connector of claim 18 wherein the second cavity end of the contact cavity is open, and the spring arm second portion is positioned to contact and be resiliently moved in response to the spring arm second portion engaging the contact by an amount sufficient to permit insertion of the contact into the contact cavity through the open second cavity end to position the receiving aperture in registration with the protrusion.

20. The connector of claim 19 wherein the spring arm second portion is sufficiently resiliently movable to further allow the spring arm second portion to be resiliently moved by an amount sufficient to disconnect the protrusion from the receiving aperture to permit the removal of the contact from the contact cavity through the open second cavity end.

21. The connector of claim 18 wherein the second cavity end is open, and the second end portion of each contact has a terminal portion extending out of the open second cavity end and beyond the body.

22. The connector of claim 18 wherein the body and the spring arms are formed with a one-piece construction.

23. The connector of claim 18 for use with a probe, wherein the receiving apertures are through-holes in the spring arms, each through-hole having an outward opening sized to receive the probe therein to make electrical contact with the contact in the contact cavity at which the spring arm is positioned.

24. The connector of claim 7 wherein the contact cavities are arranged in a common plane, the contacts are planar with the second end portion of each contact having a planar face, when the contacts are received in the contact cavities the contacts are retained in a coplanar arrangement parallel to the common plane with the planar contact faces of the contacts facing transverse to the common plane, and the second portion of each spring arm is arranged for engagement with the planar contact face of the contact in the contact cavity at which the spring arm is positioned and the protrusion projects outwardly from the planar contact face toward the second portion of the spring arm.

25. The connector of claim 7 wherein the contact cavities are arranged in a common plane, the second end portions of the contacts each has a planar face, when the contacts are received in the contact cavities the cavities retain the planar contact faces in a coplanar arrangement parallel to the common plane-with the planar contact faces facing transverse to the common plane, the second portion of each spring arm is arranged for engagement with the planar contact face of the contact in the contact cavity at which the spring arm is positioned, and the protrusion projects outwardly from the planar contact face transverse to the common plane.

26. The connector of claim 7 wherein the body is elongated along a longitudinal axis and has first and second walls extending along the body axis, the first and second body walls facing in opposite first and second directions, respectively, transverse to the body axis, the contact cavities are positioned between the first and second body walls and arranged along the body axis, the second end portions of the contacts each has a face, when the contacts are received in the contact cavities the contact faces are retained facing in the first direction and the protrusions project outwardly from the contact faces in the first direction, and the second portion of each spring arm is positioned at the first body wall and facing in the second direction and arranged for engagement with the contact face of the contact in the contact cavity at which the spring arm is positioned.

27. The connector of claim 18 wherein the contact cavities are arranged in a common plane, the contacts are planar and each contact has a planar face, when the contacts are received in the contact cavities the contacts are retained in a coplanar arrangement parallel to the common plane with the planar contact faces of the contacts facing transverse to the common plane, and each spring arm is arranged for engagement with the planar contact face of the contact in the contact cavity at which the spring arm is positioned.

28. The connector of claim 27 wherein each contact has oppositely facing first and second edge walls facing transverse to the planar contact face of the contact, and adjacent ones of the contact cavities have a dividing wall therebetween with oppositely facing first and second side walls, the first side wall being positioned to engage the first edge wall of the contact in the one adjacent contact cavity and the second side wall being positioned to engage the second edge wall of the contact in the other adjacent contact cavity to assist in holding in place the contacts in the adjacent contact cavities.

29. The connector of claim 18 wherein the contact cavities are arrange in a common plane, the second end portions of the contacts each has a planar face, when the contacts are received in the contact cavities the cavities retain the planar contact faces in a coplanar arrangement parallel to the common plane with the planar contact faces facing transverse to the common plane, the second portion of each spring arm is arranged for engagement with the planar contact face of the contact in the contact cavity at which the spring arm is positioned, the protrusion projects transverse to the common plane, and one of the planar contact face and the second portion of the spring arm has the protrusion and the other has the receiving aperture receiving therein the protrusion when the contact is in the contact cavity at which the spring arm is positioned with the receiving aperture in registration with the protrusion.

30. The connector of claim 18 wherein the body is elongated along a longitudinal axis and has first and second walls extending along the body axis, the first and second body walls facing in opposite first and second directions, respectively, transverse to the body axis, the contact cavities are positioned between the first and second body walls and arranged along the body axis, the second end portions of the contacts each has a face, when the contacts are received in the contact cavities the contact faces are retained facing in the first direction, the second portion of each spring arm is positioned at the first body wall and facing in the second direction and arranged for engagement with the contact face of the contact in the contact cavity at which the spring arm is positioned, and one of the contact face and the second portion of the spring arm has the protrusion and the other has the receiving aperture receiving therein the protrusion when the contact is in the contact cavity at which the spring arm is positioned with the receiving aperture in registration with the protrusion and with the protrusions projecting in one of the first and second directions and the receiving aperture facing in the other of the first and second directions.

31. An electrical connector of the type for electrically interconnecting a first set of insulated wire conductors with a second set of conductors, the connector comprising:

a body having a plurality of contact cavities therein, each contact cavity having an open first end for receiving one of the insulated wire conductors of the first set of conductors and an opposite second end;

a plurality of insulation penetrating beam contacts, each contact sized to be received within one of the contact cavities, each contact having a first end portion located at the first cavity end and an opposite second end portion located at the second cavity end of the contact cavity in which the contact is positioned, the first end portion configured to displace the insulation and make electrical contact with the wire of one of the insulated wire conductors of the first set of conductors; and a plurality of resilient spring arms, each spring arm positioned adjacent to one of the contact cavities, each spring arm having a first portion attached to the body and a resiliently movable second portion, the spring arms each being configured to allow the second portion thereof to move independent of the second portion of adjacent ones of the spring arms and without interference with the simultaneous movement of the second portion of adjacent ones of the spring arms, one of the second end portion of the contact and the second portion of the spring arm having a protrusion and the other having a receiving aperture receiving therein the protrusion when the contact is in the contact cavity at which the spring arm is positioned with the receiving aperture in registration with the protrusion.

32. The connector of claim 31 wherein the contact cavities are arrange in a common plane, the contacts are planar and each contact has a planar face, when the contacts are received in the contact cavities the contacts are retained in a coplanar arrangement parallel to the common plane with the planar contact faces of the contacts facing transverse to the common plane, and each spring arm is arranged for engagement with the planar contact face of the contact in the contact cavity at which the spring arm is positioned.

33. The connector of claim 32 wherein each contact has oppositely facing first and second edge walls facing transverse to the planar contact face of the contact, and adjacent ones of the contact cavities have a dividing wall therebetween with oppositely facing first and second side walls, the first side wall being positioned to engage the first edge wall of the contact in the one adjacent contact cavity and the second side wall being positioned to engage the second edge wall of the contact in the other adjacent contact cavity to assist in holding in place the contacts in the adjacent contact cavities.

34. The connector of claim 31 wherein the contact cavities are arrange in a common plane, the second end portions of the contacts each has a planar face, when the contacts are received in the contact cavities the cavities retain the planar contact faces in a coplanar arrangement parallel to the common plane with the planar contact faces facing transverse to the common plane, the second portion of each spring arm is arranged for engagement with the planar contact face of the contact in the contact cavity at which the spring arm is positioned, the protrusion projects transverse to the common plane, and one of the planar contact face and the second portion of the spring arm has the protrusion and the other has the receiving aperture receiving therein the protrusion when the contact is in the contact cavity at which the spring arm is positioned with the receiving aperture in registration with the protrusion.

35. The connector of claim 31 wherein the body is elongated along a longitudinal axis and has first and second walls extending along the body axis, the first and second body walls facing in opposite first and second directions, respectively, transverse to the body axis, the contact cavities are positioned between the first and second body walls and arranged along the body axis, the second end portions of the contacts each has a face, when the contacts are received in the contact cavities the contact faces are retained facing in the first direction, the second portion of each spring arm is positioned at the first body wall and facing in the second direction and arranged for engagement with the contact face of the contact in the contact cavity at which the spring arm is positioned, and one of the contact face and the second portion of the spring arm has the protrusion and the other has the receiving aperture receiving therein the protrusion when the contact is in the contact cavity at which the spring arm is positioned with the receiving aperture in registration with the protrusion and with the protrusions projecting in one of the first and second directions and the receiving aperture facing in the other of the first and second directions.

36. The connector of claim 31 wherein the second cavity end of the contact cavity is open, and the spring arm second portion is positioned to contact and be resiliently moved in response to the spring arm second portion engaging the contact by an amount sufficient to permit insertion of the contact into the contact cavity through the open second cavity end to position the receiving aperture in registration with the protrusion.

37. The connector of claim 36 wherein the spring arm second portion is sufficiently resiliently movable to further allow the spring arm second portion to be resiliently moved by an amount sufficient to disconnect the protrusion from the receiving aperture to permit the removal of the contact from the contact cavity through the open second cavity end.

38. The connector of claim 31 for use with a probe, wherein the receiving apertures are through-holes in the spring arms, each through-hole having an outward opening sized to receive the probe therein to make electrical contact with the contact in the contact cavity at which the spring arm is positioned.

* * * * *